United States Patent [19]

Kaiser

[11] 4,443,232

[45] Apr. 17, 1984

[54] DEAERATED LIQUID STOCK SUPPLY

[75] Inventor: Robert G. Kaiser, Seminole, Fla.

[73] Assignee: Clark & Vicario Corporation, Pinellas Park, Fla.

[21] Appl. No.: 427,914

[22] Filed: Sep. 29, 1982

[51] Int. Cl.[3] ..... B01D 19/00

[52] U.S. Cl. ..... 55/41; 55/55; 55/191; 55/194; 55/204; 162/190; 162/264; 162/DIG. 7

[58] Field of Search ..... 55/41, 48, 55, 191, 55/194, 204, 210; 162/190, 264, DIG. 7; 209/211

[56] References Cited

U.S. PATENT DOCUMENTS

| | | | |
|---|---|---|---|
| Re. 29,472 | 11/1977 | Kaiser | 55/55 X |
| 2,571,219 | 10/1951 | DeCew | 55/55 X |
| 2,614,656 | 10/1952 | Clark et al. | 55/55 |
| 2,685,937 | 8/1954 | Clark et al. | 55/55 X |
| 2,849,930 | 9/1958 | Freeman et al. | 55/55 X |
| 3,095,348 | 6/1963 | Goldsmith | 55/55 X |
| 3,206,917 | 9/1965 | Kaiser et al. | 55/48 X |
| 3,421,622 | 1/1969 | Wurtmann | 55/41 X |
| 3,432,036 | 3/1969 | Kaiser | 55/41 X |
| 3,513,971 | 5/1970 | Wikdahl | 209/3 |
| 3,538,680 | 11/1970 | Kaiser | 55/41 |
| 3,598,731 | 8/1971 | Frykhult | 210/94 |
| 3,716,449 | 2/1973 | Gatward et al. | 162/190 X |
| 3,960,653 | 6/1976 | Futcher et al. | 162/190 X |
| 4,146,469 | 3/1979 | Kaiser et al. | 209/211 |
| 4,219,340 | 8/1980 | Kaiser | 55/41 |
| 4,378,978 | 4/1983 | Andersson et al. | 55/55 X |

*Primary Examiner*—Robert H. Spitzer
*Attorney, Agent, or Firm*—Vogt & O'Donnell

[57] ABSTRACT

Apparatus for supplying deaerated stock to a processing machine incorporates an enclosed first receiver and a second receiver open to the atmosphere. Stock deaerated by vacuum in the first receiver flows to the second receiver. Some of such stock spills over a weir associated with the second receiver to maintain a constant-level pond in such receiver. Stock is supplied to the machine from such constant-level pond, so that the pond minimizes stock pressure fluctuations at the machine. The stock spilling over the weir is recycled to the first receiver. During a temporary shutdown of the processing machine, the system may be maintained in operation with continuous recirculation of stock through the receivers to facilitate rapid restarting of the machine. Because there is no need for a pond of stock in the enclosed receiver, such receiver may be compact. The system may be installed in a preexisting mill and space within a preexisting vessel may be used for the second receiver.

43 Claims, 11 Drawing Figures

16
12
31
14
10
26
12
24
24
20
18
18
22
k
27
28
30
104
50
68
e
h
29
68
90
98
96
2
100
94
92
29
78
80
86
102
39
32
2
84
3
48
40
36
37
68
82
78
52
46
29
66
74
103
76
70
72
44
88
105
38
42
34
3
60
56
54
58
62
106
107
64
96
100
80
32
86
78
82
84

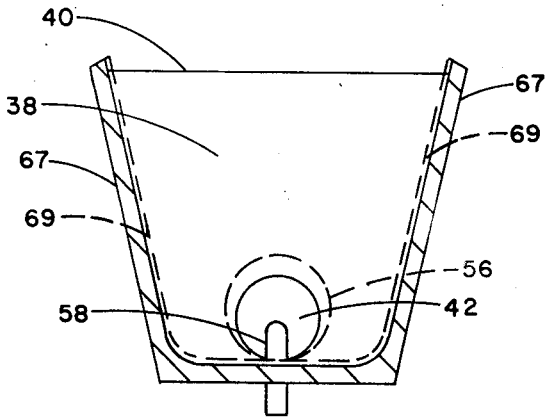
FIG. 3
FIG. 4
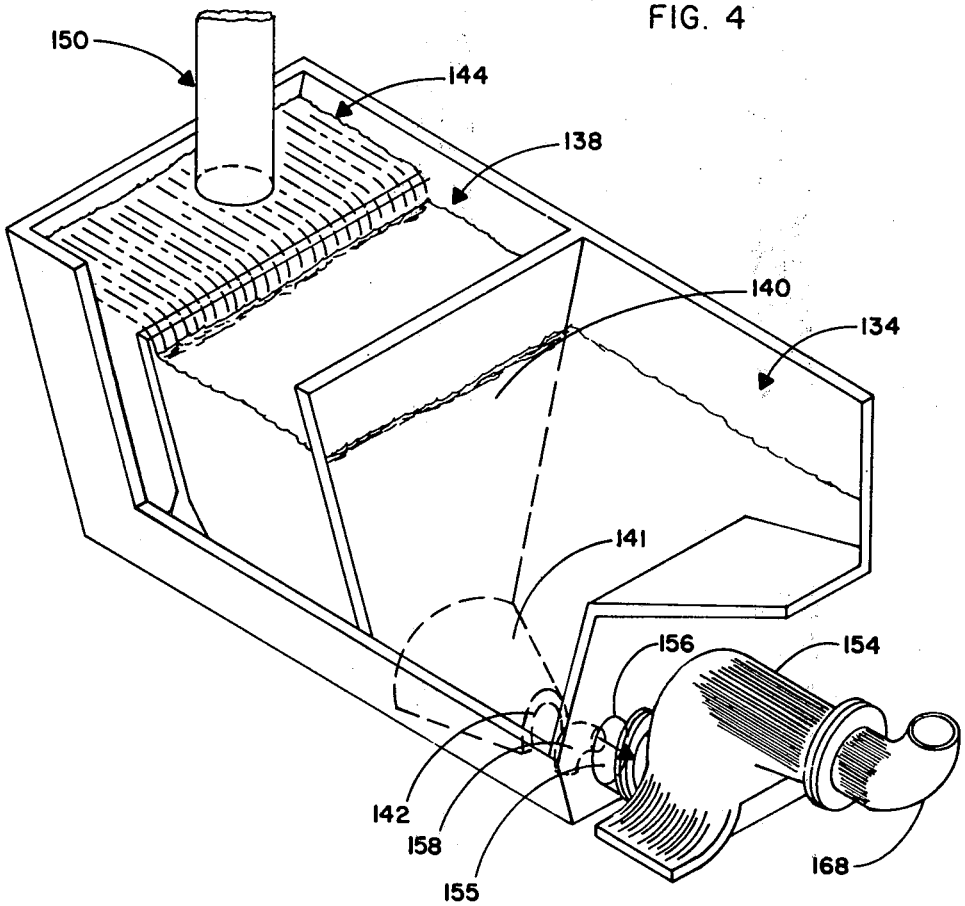

DEAERATED LIQUID STOCK SUPPLY

BACKGROUND OF THE INVENTION

The present invention relates to the art of liquid stock deaeration and supply. More particularly, the present invention relates to apparatus and methods for providing a flow of deaerated stock to a processing machine.

The manufacturing processes utilized in various industries employ liquid stocks or feed materials. For example, in the papermaking industry, suspensions of cellulosic fibers in water are employed as feedstocks for papermaking machines. As air entrained in such a feedstock may cause defects in the finished product and may impair the efficiency of the processing operation, various devices have been utilized for deaerating liquid stock before it is fed to a processing machine. Such devices generally employ an enclosed receiver and means for maintaining such receiver under a vacuum. The stock is introduced into the receiver and exposed to the vacuum to remove air from it.

The stock may be introduced into the vacuum receiver via spray pipes extending upwardly through the bottom wall of the receiver. In this arrangement, the stock is projected upwardly within the empty space or headspace in the receiver and impinges upon the top wall of the receiver to form finely divided droplets, thus intimately exposing the stock to the vacuum in the receiver for effective deaeration. The droplets fall to the bottom of the receiver where the deaerated stock is collected. Such an arrangement of spray pipes may be employed in a system where the stock is cleaned by hydrocyclones prior to deaeration. A large number of individual hydrocyclones may be disposed beneath the vacuum receiver and the "accept outlet" or clean stock outlet of each such hydrocyclone may be connected to one of the spray pipes.

In other arrangements, the stock to be deaerated may be introduced into the receiver at the top and directed so that it flows downwardly along the interior walls of the receiver in the form of a thin film, thus exposing it to the vacuum in the headspace. Regardless of whether the spray or film arrangement is utilized, the headspace space within the receiver should be large enough that the falling stock will be exposed to the vacuum for a long enough time to permit adequate deaeration.

The deaerated stock is ordinarily conveyed from the vacuum receiver to the processing machine via appropriate piping. The vacuum receiver is often mounted in an elevated location above the processing machine. In this arrangement, the "dropleg" or pipe extending downwardly from the receiver is filled with stock. Gravitational head or pressure of the stock in such pipe counteracts the vacuum or negative gauge pressure in the receiver, and thus assists flow of deaerated stock from the receiver. Also, mounting of the vacuum receiver in an elevated location conserves floor space in the mill.

A pump may be interposed in the piping between the vacuum receiver and the processing machine. Whether or not a pump is utilized, fluctuations in the conditions prevailing within the vacuum deaeration system may produce fluctuations in the stock pressure at the processing machine. For example, fluctuations in the level of stock in the vacuum receiver or in the piping connecting the receiver to the processing machine will induce corresponding fluctuations in the head or pressure of the stock at the processing machine. If a fluctuating vortex forms at the outlet of the vacuum receiver, such vortex may produce additional pressure fluctuations at the processing machine.

Fluctuations in stock pressure may in turn cause fluctuations in the rate of stock flow into the processing machine, and thus may produce undesirable variations in the operation of the machine. For example, fluctuations in the stock pressure and stock flow rate into a conventional papermaking machine will generally induce undesirable non-uniformity of weight, thickness and strength in the finished paper.

U.S Pat. 3,206,917 issued Sept. 21, 1965 to R. G. Kaiser, et al. describes a system for maintaining substantially constant stock pressure and flow to prevent such inefficiencies. The system disclosed in the Kaiser '917 patent employs a weir within the vacuum receiver, such weir subdividing the receiver into a main portion and an overflow portion. An outlet in the bottom of the main portion is connected to the processing machine. Stock is introduced into the main portion of the receiver and deaerated therein at a rate greater than the rate of stock withdrawal through the bottom outlet, so that a pond of deaerated stock accumulates in the bottom of the main portion until its level reaches the top of the weir, whereupon the excess stock overflows the weir. As long as the rate of deaerated stock production is greater than the rate of stock withdrawal through the main bottom outlet, excess stock will continually overflow the weir and the level of the pond in the main portion of the receiver will thus remain substantially constant, such level being substantially equal to the level of the top or crest of the weir. Such constant-level pond provides a constant stock pressure. The excess stock entering the overflow portion of the receiver is removed from the overflow portion by a separate recycle line and passed back to the stock supply for reintroduction into the receiver along with other stock to be deaerated.

Because this system economically provides both effective deaeration and effective protection against stock pressure fluctuations, it has been widely adopted by the papermaking industry. The present invention, however, incorporates recognition of certain opportunities for even further improvement.

In apparatus acccording to the Kaiser '917 patent, the pond of deaerated stock occupies space at the bottom of the vacuum receiver. The vacuum receiver, therefore, must be large enough to contain both the pond and a headspace of adequate size above the pond. The vacuum receiver may be completely filled with liquid stock during abnormal operation or during hydrostatic testing. The receiver-supporting structure must normally be designed to support the weight of the receiver in this completely-filled condition, and such weight is directly proportional to the volume of the receiver. Elimination of the pond within the vacuum receiver, or substantial reduction in the size of such pond, would permit use of a smaller, less expensive receiver and would also permit use of a less expensive supporting structure.

Moreover, deaeration apparatus according to the Kaiser '917 patent generally is not maintained in operation when operation of the processing machine is temporarily interrupted. During such a temporary shutdown of the processing machine, outflow of stock through the main outlet at the bottom of the main portion of the receiver is interrupted. If the deaeration apparatus were maintained in operation, all of the deaerated stock would have to exit from the receiver via the recycle line. It is costly to provide the recycle line with sufficient capacity for such flow and to provide the recirculation piping needed to prevent undesirable stagnation of stock contained in the piping leading from the main outlet of the receiver to the processing machine during such a shutdown.

Deaeration systems generally require substantial time to reach equilibrium after restarting. If operation of the deaeration system is interrupted during a temporary shutdown of the processing machine and then restarted when the machine is restarted, the machine may not make useful product until the deaeration system reaches equilibrium. Continued operation of the deaeration system during temporary machine shutdowns minimizes the loss of productive time and materials upon restarting of the processing machine. Thus, a deaeration system which could be more economically provided with capacity for continued operation during temporary processing machine shutdowns would be most desirable.

SUMMARY OF THE INVENTION

The present invention provides these desirable improvements in deaeration apparatus.

Apparatus according to the present invention includes an enclosed first receiver and means for maintaining the first receiver under a vacuum. The apparatus also includes means for suppplying stock to be deaerated and means for introducing such stock into the first receiver to produce deaerated stock at a predetermined average production rate. The apparatus also includes a second receiver open to the atmosphere, and means for conducting deaerated stock from the first receiver to the second receiver.

Means for withdrawing stock from the second receiver and transferring it to the processing machine are also provided. The stock withdrawing means are arranged to take stock from the second receiver at a rate lower than the average rate at which deaerated stock is produced in the first receiver. Thus, deaerated stock will accumulate in the second receiver, forming a pond. The apparatus also includes level control means for discharging an excess or "recycle" portion of the deaerated stock from the pond and varying the rate of discharge to maintain the pond at a predetermined level. The level control means may include a weir, in which case the recycle stock will overflow the weir to maintain the pond level. This provides a substantially constant head or stock pressure in the second receiver, which minimizes stock pressure fluctuations at the processing machine. Because the weir is outside of the vacuum receiver, its size is not limited by the size of the vacuum receiver. This is a significant advantage, inasmuch as longer weirs generally provide more accurate level control.

Recycle means are provided for passing the recycle stock discharged from the second receiver by the level control means back to the stock introducing means for reintroduction into the first receiver.

Because apparatus according to the present invention need not maintain a pond of deaerated stock within the first or vacuum receiver, the vacuum receiver can be smaller, lighter and less costly than a comparable vacuum receiver designed to accommodate a pond of deaerated stock. In some embodiments, the vacuum receiver may consist entirely of a relatively inexpensive assemblage of pipes in the form of a manifold.

The stock supply means may include a tank and means for collecting at least a portion of the stock to be deaerated in the tank, and the stock-introducing means may be arranged to take such stock from the tank. For example, the present apparatus may be used with a papermaking machine which produces both paper and a return fluid of relatively low fiber content known as "white water." The white water may be collected in a tank known as a "wire pit" or "silo", and the stock-introducing means may be arranged to draw the white water from such tank, together with fresh or "makeup" stock of relatively high fiber content for, introduction into the first or vacuum receiver. Preferably, the second receiver is disposed adjacent such tank and the recycle means are connected to the introducing means in the vicinity of the tank. As the recycle means need not transport the recycle stock through a great distance, it is practical to construct the recycle means with sufficient reserve capacity to accommodate the entire flow of deaerated stock. The level control means may also be provided with the capacity to accomodate the entire stock flow. For example, a weir of reasonable size will inherently possess such capacity. If such reserve capacity is provided in the level-control and recycle means, the deaeration system can be maintained in operation during a temporary interruption in operation of the associated processing machine. During any such interruption, operation of the stock-withdrawing means is also interrupted. The entire flow of deaerated stock passing from the first receiver into the second receiver is discharged from the second receiver by the level-control means and passes via the recycle means to the introducing means which sends it back to the first receiver.

Because the system continues to operate under substantially equilibrium conditions, the processing machine can be provided with fully usable stock under stable pressure and flow conditions almost immediately after it has been restarted, thereby restoring the machine to full productivity in the shortest possible time.

One way of connecting the recycle means to the introducing means in the vicinity of the tank is to connect the recycle means to the introducing means by way of the tank. Thus, the recycle means may be arranged to pass the recycle stock into the tank. In some embodiments, an overflow chamber communicating with the tank may be provided, and the overflow chamber may be disposed between the second receiver and the tank, so that recycle stock passes into the overflow chamber and passes through the overflow chamber to the tank. The overflow chamber may be separated from the tank by a shared common wall, and the second receiver may be separated from the overflow chamber by another common wall. In such an arrangement, the recycle means need not include any piping whatever, and adequate reserve capacity in the recycle means can be provided readily. The common wall between the second receiver and overflow chamber may serve as the weir of the level-control means.

A further significant advantage of this arrangement is that when installing the deaerating system in an existing mill which already has a tank in the form of a wire pit or silo, the second receiver and overflow chamber may be formed by installing appropriate partition walls within the tank, without constructing entirely new vessels. In some cases, this may be accomplished without enlarging the original tank at all. The present invention thus provides improved methods of installing deaeration apparatus in an existing mill, which may effect substantial savings in installation costs.

The present invention also provides improved methods of operating a stock deaeration system to supply deaerated stock to a processing machine. In the preferred operating methods according to the present invention, stock flow is maintained in the major portion of the deaeration system during interruptions in operation of the processing machine.

These and other objects, features and advantages of the present invention can be better appreciated from the detailed description of the preferred embodiments set forth below, taken in conjunction with the accompanying drawings.

BRIEF DESCRIPTION OF THE DRAWINGS

FIG. 3 is a fragmentary sectional view taken along line 3—3 in FIG. 1.

FIG. 4 is a fragmentary, perspective cutaway view illustrating portions of apparatus according to a second embodiment of the present invention.

DETAILED DESCRIPTION OF THE PREFERRED EMBODIMENTS

Figures 1, 2:
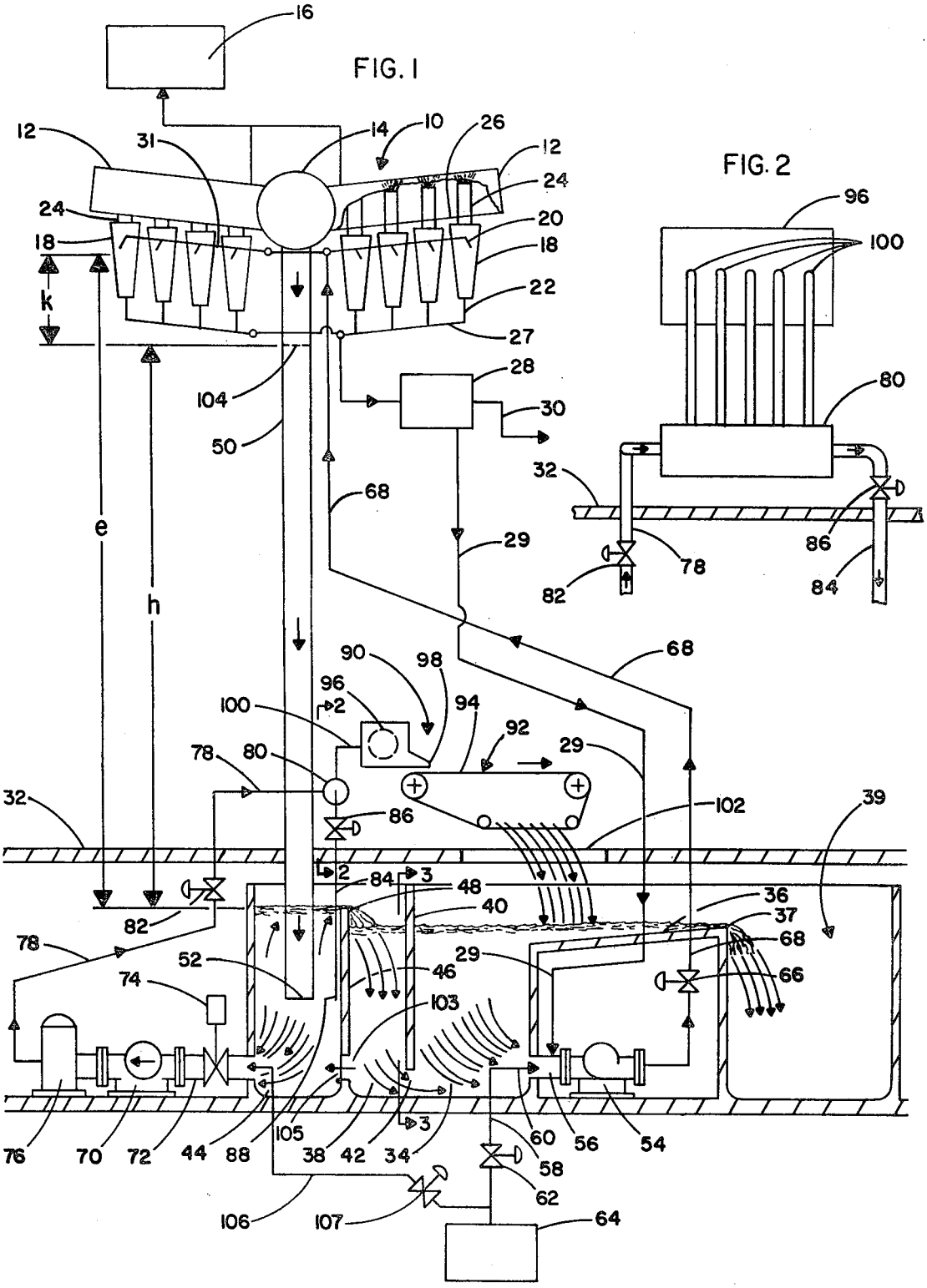
FIG. 1 is a schematic view illustrating apparatus according to a first embodiment of the present invention in conjunction with a processing machine.
FIG. 2 is a fragmentary elevational view, taken along line 2—2 in FIG. 1.

As shown in FIG. 1, apparatus according to a first embodiment of the present invention includes an enclosed first receiver 10 in the form of an assemblage of pipes including a plurality of wing pipes 12 joined to a central manifold 14. Wing pipes 12 slope upwardly from their junctures with manifold 14. Although only two of the wing pipes are visible in FIG. 1, receiver 10 may include a large number of such wing pipes, these being mounted along the length of central manifold 14. Receiver 10 is connected to a vacuum pump and condenser assembly 16.

A plurality of centrifugal cleaners or hydrocyclones 18 are mounted beneath the wing pipes of the receiver, the elongated bodies of such hydrocyclones extending generally vertically in side-by-side parallel relation with one another. Each hydrocyclone has a feed inlet 20 and also has a reject stock outlet 22 at the lower end of its body. The stock inlets 20 of hydrocyclones 18 are connected to a feed manifold 31. A spray pipe 24 is connected to the accept or clean stock outlet at the top of each hydrocyclone. Each such spray pipe extends upwardly through the bottom wall 26 of the associated wing pipe 12 of the receiver, and terminates in an open end within such wing pipe. The reject outlets 22 of the hydrocyclones are connected to a reject manifold 27 which in turn is connected to additional cleaning stages 28. Such additional cleaning stages are provided with a reclaim discharge line 29 and a reject drain 30. Hydrocyclones 18 may be attached to receiver 10 by mounting structures such as those set forth in U.S. Pat. No. 4,146,469, issued Mar. 27, 1979 to Robert G. Kaiser et al. The disclosure of such patent, insofar as it pertains to such mounting structures, is hereby incorporated by reference in this disclosure. Additional cleaning stages 28 may include any conventional stock-cleaning apparatus such as, for example, additional arrays of hydrocyclones. The hydrocyclones 18 and receiver 10 are mounted at an elevated location above the mill floor 32.

A wire pit or tank 34 is disposed beneath mill floor 32, a drainage ramp 36 being mounted adjacent the top of tank 34 and sloping downwardly towards the tank, the upper end 37 of such ramp being disposed adjacent a couch pit 39. An overflow chamber 38 is provided immediately adjacent tank 34, chamber 38 being separated from tank 34 by an upwardly extending common wall 40, the overflow chamber communicating with the tank at an inlet location adjacent the bottom of the tank via an opening 42 in common wall 40 at such location. A second receiver 44 is provided immediately adjacent overflow chamber 38, the second receiver being separated from the overflow chamber by an upwardly extending common wall 46 therebetween. Second receiver 44, chamber 38 and tank 34 are open to the atmosphere. The top edge 48 of common wall 46 is lower than the top edges of the other walls bounding second receiver 44, so that wall 46 in effect defines a weir limiting the height of any pool of fluid accumulating in receiver 44, edge 48 constituting the crest of such weir. Such edge or crest 48 is disposed at an elevation slightly higher than the elevation of upper end 37 of ramp 36. A barometric dropleg or conduit 50 extends downwardly from central manifold 14 of first receiver 10 to second receiver 44, such conduit terminating in an open end 52 within second receiver 44 below the level of weir crest 48.

A centrifugal pump 54 is connected to tank 34 by a suction line 56, such suction line communicating with the tank at an outlet location adjacent the bottom of the tank, on the opposite side of the tank from the aforesaid inlet location and opening 42. Reclaim discharge line 29 from additional cleaning stages 28 is connected to suction line 56. A makeup stock supply pipe 58 extends into the tank to an open end 60 immediately adjacent the open end of suction pipe 56, the supply pipe being connected by way of a valve 62 to a source of makeup stock 64. The outlet or pressure side of pump 54 is connected via a control valve 66 and a riser line 68 to the inlet or feed manifold 31 associated with cleaners 18.

A second centrifugal pump 70 is disposed adjacent second receiver 44, the suction side of such pump being connected via a stock withdrawing conduit 72 to the second receiver. Conduit 72 communicates with receiver 44 at a location below weir crest 48 and below the open end 52 of dropleg 50. The stock withdrawing conduit is provided with a shut-off valve 74. The discharge or pressure side of pump 70 is connected, through a screen 76 and a feed conduit 78, to one end of an elongated headbox distributing manifold 80 disposed above mill floor 32 (FIGS. 1 and 2), a headbox supply control valve 82 being interposed in conduit 78. A balancing or end connecting conduit 84 having a control valve 86 communicates with manifold 80 at the end of such manifold opposite from its connection with supply line 78. Balancing conduit 84 extends downwardly from manifold 80 into second receiver 44, and terminates in an open end 88 disposed within the second receiver below the level of weir crest 48.

As best seen in FIG. 3, the opening 42 in wall 40 is aligned with the intake opening of suction line 56. The side walls 67 of overflow chamber 38 slope inwardly towards one another adjacent the bottom of such chamber (adjacent opening 42), and side walls 69 of tank 34 likewise slope inwardly towards one another adjacent the bottom of the tank. The side walls of second receiver 44 (FIG. 1) are arranged in a similar fashion, and slope inwardly towards one another adjacent the bottom of the receiver. Tank 34, chamber 38 and receiver 44 are provided with generous radii at their edges and corners to minimize stock stagnation at such locations.

A conventional papermaking machine 90 is disposed above mill floor 32. The machine includes a continuous wire mesh belt 92, commonly referred to as a fourdrinier belt, such belt being supported by rollers and driven so that the horizontally extending top run 94 of the belt moves to the right as seen in FIG. 1. A headbox or chamber 96 is mounted adjacent the left or upstream end of top belt run 94, the headbox having a slit-like opening or slice 98 disposed above such run. Headbox 96 is connected, via a plurality of pipes 100 to headbox manifold 80. Fourdrinier belt 92 is disposed above an opening 102 in mill floor 32, such opening overlying wire pit or tank 34 and the ramp 36 associated therewith.

A port 103 extends through wall 46 adjacent the bottom of chamber 38, the port being provided with a check valve 105 arranged to prevent flow from second receiver 44 to chamber 38 but permit flow in the opposite direction. A makeup stock diversion line 106 is connected to makeup stock supply source 64 via a valve 107. Diversion line 106 terminates in an open end within second receiver 44 adjacent the opening of suction conduit 72. Valves 105 and 107 remain closed during normal operation of the apparatus.

In normal operation, vacuum apparatus 16 maintains receiver 10 under a vacuum. Centrifugal pump 54 draws stock from tank 34 and forces such stock upwardly through riser line 68 and feed manifold 31 into cleaners 18. The cleaners separate the stock into a relatively heavy, dirty rejects fraction and a relatively light, clean accepts fraction. The rejects fraction is discharged from the cleaners through manifold 27 to additional cleaning stages 28. In the additional cleaning stages, the rejects from cleaners 18 are separated into a reclaim portion of about the same cleanliness as the original stock and an extremely dirty final reject portion. The reclaim portion is returned via reclaim line 29 to pump 54, and the final rejects portion is discarded via drain 30.

The accepts fraction or clean stock discharged from cleaners 18 is introduced via spray pipes 24 into the wing pipes 12 of first receiver 10, such stock spraying upwardly from the spray pipes within the wing pipes of the receiver and impinging on the top walls of the wing pipes. Upon such impingement, the stock forms minute droplets so that it is intimately exposed to the vacuum in the first receiver, such exposure removing air from the stock and producing deaerated stock. Substantially all of the stock introduced into the first receiver via the spray pipes is converted into deaerated stock in this fashion, except that a miniscule fraction of the water included in the stock is lost via evaporation under the vacuum maintained in the receiver, the resulting vapor being removed from first receiver 10 by vacuum apparatus 16. Thus, the average rate at which deaerated stock is produced in first receiver 10 will be only very slightly less than the average rate at which stock is introduced into the receiver via spray pipes 24. The average rate of stock introduction via spray pipes 24 and hence the average rate of production of deaerated stock in first receiver 10 may be controlled by controlling the pressure exerted by pump 54, or by adjusting the flow resistance of valve 66.

The deaerated stock produced in receiver 10 flows from such receiver to second receiver 44 via dropleg conduit 50 at an average rate substantially equal to the rate at which such deaerated stock is produced in the first receiver. Deaerated stock is in turn removed from the second receiver through conduit 72 by second centrifugal pump 70 and forced through screen 76 and supply line 78 to headbox manifold 80. The major portion of such stock is transferred to headbox 96 via conduits 100 and processed by the papermaking machine 90. However, a minor portion of the stock reaching manifold 80 is returned to second receiver 44 via conduit 84. The net rate at which stock is withdrawn from receiver 44 and transferred to the papermaking machine via conduits 100 will be equal to the rate of flow through centrifugal pump 70 and the associated conduits less the rate of return flow through balancing conduit 84. Such net rate of withdrawal may be controlled by adjusting valves 82 and 86. In normal operation, such valves are adjusted so that such net rate of withdrawal is less than the average rate at which deaerated stock enters receiver 44 from conduit 50, i.e., less than the average rate at which deaerated stock is produced in receiver 10. Accordingly, a pond of deaerated stock accumulates in second receiver 44 and a recycle portion of the stock in such pond continually spills out of second receiver 44 over weir crest 48. The recycle stock discharged over the weir drops into overflow chamber 38 and passes into the bottom of tank 34 via the opening 42 in wall 40. As the level of stock in receiver 44 is higher than the level in chamber 38, the pressure of stock in chamber 44 will keep check valve 105 closed.

The rate at which the recycle stock is discharged from the second receiver over the weir varies so as to counteract the effect of any variation in the rate of stock inflow to such receiver via dropleg 50. If such inflow rate increases, the level of the pond in second receiver 44 will tend to rise. However, even a very minor rise in the pond level will cause a substantial increase in the rate of spillage over the weir, which tends to prevent any further increase in the pond level. Conversely, a very slight decrease in the pond level, such as may occur upon a momentary decrease in stock inflow via dropleg 50, will produce a substantial decrease in the rate of spillage over the weir.

The weir thus maintains the pond at a predetermined level. The accuracy of such regulation will depend to some degree upon the configuration and size of the weir. A level weir having a crest extending at a uniform height generally provides more accurate control of the pond height than a notched weir. The control accuracy of a level weir generally increases in proportion to its length. For a typical system incorporating a level weir extending across the entire width of the second receiver, the pond level will not vary by more than a few inches.

Dropleg 50 is connected to suction pipe 72 of the stock-withdrawing means only by the open second receiver 44. There is no closed conduit interconnecting the dropleg and the stock-withdrawing means. This arrangement is believed to minimize transmission of pulsations or pressure waves from the dropleg and first receiver to the stock-withdrawing means and processing machine. Such pulsations may be dissipated in the pond of stock within second receiver 44.

As used in this disclosure with reference to stock pressure, the term "fluctuation" means a rapid variation in such pressure, occurring during a period of less than about 1 minute. The pressure of the stock in manifold 80 will be equal to the pressure in the second receiver at the inlet to pipe 72 plus the pressure increase or "boost" applied by pump 70, minus the difference in pressure due to the higher elevation of manifold 80 and minus the pressure losses caused by the associated pipes, valves and screen. Because the level of the stock pond in second receiver 44 is maintained substantially constant and such receiver is open to the atmosphere, the stock pressure at the inlet to conduit 72 will also be substantially constant and will be free of any significant fluctuations.

During normal system operation, valves 82 and 86 are maintained at substantially constant settings and do not cause any fluctuations in the stock pressure at the manifold. Also, although gradual plugging of screen 76 may cause a very slow decrease in stock pressure at the manifold such plugging normally will not cause any fluctuation in such stock pressure. For practical purposes, the only fluctuations in the stock pressure at manifold 80 will be those imposed by pump 70. Thus, pump 70 should be selected so that any fluctuations in the boost applied by the pump will be less than the maximum stock pressure fluctuations which can be tolerated in operation of the processing machine. This tolerance will depend upon the requirements of the particular processing operation.

The stock delivered to the headbox is discharged from the headbox through opening or slice 98 onto the top run 94 of fourdrinier belt 92. The majority of the fibers contained in the stock are retained on the belt and converted into paper in the conventional manner. Because stock is delivered to headbox 96 without substantial pressure fluctuations, the rate of stock discharge through slice 98 can be maintained free of substantial fluctuations. Such fluctuation-free discharge of stock onto the machine belt minimizes variations in the amounts of fibers deposited on successive portions of the belt and accordingly, minimizes undesirable variations in the weight and thickness of the ultimate paper product.

The major portion of the liquid from the stock on the belt drains through the belt as a return fluid of relatively low fiber content known as white water. Most of the white water drains downwardly under the influence of gravity into tank 34 via ramp 36. A small amount of the white water spills over the upper end 37 of ramp 36. In effect, the upper end of the ramp serves as a weir and maintains the levels of fluid in tank 34 and chamber 38 below the level of weir crest 48. The white water spilling over ramp end 37 may be captured in couch pit 39 or in other vessels (not shown) and may be discharged from the system.

The white water entering tank 34 passes downwardly within the tank and blends with the recycle stock entering the tank via opening 42, the blend stock passing into suction line 56, to first pump 54 and back through the system once again. Makeup stock which is relatively "thick" or high in fiber content is added to the blend stock through makeup line 58 as the blend stock is drawn into suction line 56, thus compensating for the relatively low fiber content of the white water.

As will be appreciated, the consistency or fiber content of the blend stock entering suction line 56 will be influenced by the proportions of recycle stock (from overflow chamber 38), return fluid or white water (from the papermaking machine) and makeup stock (from the makeup line) drawn into the suction line. Because the open end 60 of makeup line 58 is disposed immediately adjacent the entrance to suction line 56, substantially all of the makeup stock discharged from the makeup line will pass directly into the suction line. It is believed that passage of the recycle stock into the tank through opening 42 adjacent the bottom of the tank promotes relatively stable, primarily horizontal flow of recycle stock along the bottom of the tank. The inwardly-sloping side walls 69 of the tank (FIG. 3) restrict the downwardly flowing white water in tank 34 to a narrower area adjacent the bottom of the tank, thus providing a relatively rapid downwardly flow in the lower portion of the tank. It is believed that such relatively rapid downward flow also promotes stable flow of recycle stock along the bottom of tank 34. Because the top of the tank has a relatively large area, the downward flow of white water in the upper region of the tank is relatively slow. Such slow downward flow is desirable inasmuch as it permits large bubbles of air entrained in the white water to escape. Also, because opening 42 is aligned with the opening of suction line 56, the path of the recycle stock along the bottom of the tank is straight, and this also tends to promote stable flow. Such stable flow of recycle stock tends to provide a stable proportion of recycle stock to return stock at the entrance to suction line 56.

Although the rate at which recycle stock spills over weir crest 48 into overflow chamber 38 may also fluctuate over short periods of time, the average spill rate of recycle stock over long periods of time will remain substantially constant. Short term fluctuations in such spill rate will be dissipated in the combined volumes of overflow chamber 38 and tank 34, and hence will not cause extreme fluctuations in the consistency of the blend stock drawn into suction line 56. Further, fluctuations in the consistency of the blend stock drawn through suction line 56 will be masked by the remaining elements of the system. Stock passing through those of cleaners 18 remote from central manifold 14 must travel through a relatively long path in going from riser 68 to conduit 50. By contrast, stock passing through those cleaners 18 adjacent central manifold 14 travels a shorter path. Stock entering conduit 50 at any given time will therefore be a blend of stock which passed up through riser 68 at various times. Moreover, the stock withdrawn from second receiver 44 will include stock which entered such receiver at various times via conduit 50. Thus, stock drawn in through suction pipe 56 at any given time will be blended with stock drawn in through the suction pipe at other times before the stock reaches the papermaking machine.

As noted above, first receiver 10 and conduit 50 are arranged so that the conduit conducts the deaerated stock from the first receiver as such stock is produced. No pond of deaerated stock accumulates in the receiver. Rather, the top 104 of the column of fluid stock within drop leg 50 is maintained at a level lower than the bottom of the receiver. The upper region of conduit 50, above the fluid stock column, is not completely filled with stock. Deaerated stock flowing along the bottom of receiver central manifold 14 passes downwardly through such upper region to the top 104 of the fluid stock column.

The stock at the top of the column in conduit 50 (at top level 104) is under a subatmospheric pressure equal to the subatmospheric pressure within receiver 10. By contrast, the fluid at the top of the pond in second receiver 44 is under atmospheric pressure. For the stock in the column to flow downwardly as new stock enters the top of the column, the gravitational hydrostatic head or pressure exerted by the stock in the column must be great enough to overcome this pressure difference and to overcome any frictional losses in conduit 50. Stated another way, top level 104 is in equilibrium at that height h above weir crest 48 where the hydrostatic pressure of the stock in the column balances the pressure difference due to the vacuum in receiver 10 and the frictional pressure losses in conduit 50. In effect, the column of fluid in conduit 50 is maintained at height h by the vacuum applied by source 16.

The maximum possible pressure difference due to the vacuum in first receiver 10 would occur if such receiver were maintained under a complete vacuum (zero absolute pressure). Such maximum difference would be equal to the prevailing atmospheric pressure. Ordinarily, the frictional pressure losses in conduit 50 are small. Thus, the maximum height h of the column of stock in the conduit 50 corresponds to the head of stock equal to the prevailing atmospheric pressure. If the elevation e of first receiver 10 above weir crest 48 is more than the maximum height h for the prevailing atmospheric pressure at the location of the mill, the top 104 of the fluid stock column will remain below the bottom of the receiver under all operating conditions. For normal sea level atmospheric pressure and aqueous stock, the maximum height h of the stock column would be about 33.9 feet (10.3 meters) and a receiver elevation e of about 34 feet (10.36 meters) or more preferred.

The deaeration and stock supply system operates continuously while the papermaking machine is running. Operation of the deaerated stock supply system can continue if operation of the papermaking machine is temporarily interrupted, as by mechanical problems or the like. For continued deaeration system operation during such a machine shutdown without continued transfer of stock to the papermaking machine, valve 74 is closed, and the power to pump 70 may also be interrupted. When the system is in this condition, all of the deaerated stock produced in first receiver 10 and passed to the second receiver via conduit 50 overflows weir crest 48. Stated another way, in this condition the average spill rate of recycle stock over the weir is equal to the average rate of deaerated stock production in the first receiver. The recycle stock blends with the stock in tank 34 and passes back to suction pipe 56, so that the same stock simply recirculates through the system.

As none of the recirculating stock passes through the papermaking machine, no fibers are removed from the stock by the papermaking machine and no white water is produced. Once the recycle stock has been fully mixed with the white water present in tank 34 at the start of the shutdown, the recirculating stock will not be further diluted by white water. Therefore, continued addition of thick makeup stock via makeup line 58 is unnecessary. Makeup stock may be added at the beginning of a shutdown to compensate for dilution of the recirculating stock by the white water initially present in tank 34. After such white water has been fully mixed with the recirculating stock, valve 62 is closed.

With continued operation of the system in this mode, a very minor fraction of the stock will be lost by discharge through drain line 30. Such stock consists of the stock rejected by cleaners 18 and not reclaimed in additional cleaning stages 28. Thus, the amount of recirculating stock in the system will decrease slowly as the system continues to operate in shutdown mode. Such decrease will ordinarily not cause any difficulty in operation as it will merely cause the level of stock in overflow chamber 38 and tank 34 to drop gradually.

If operation of the system in this shutdown mode must be continued for a prolonged period, thick makeup stock and water may be added to compensate for the loss of stock. Alternatively, loss of stock may be prevented by directing the reject stock from drain line 30 back into the system, as by cross-connecting discharge line 30 to reclaim line 29 through appropriate piping (not shown). During such diversion, no dirt will be removed from the system. However, as no new stock will enter the system in this condition, no new dirt will enter the system and the concentration of dirt in the recirculating stock will not increase.

Whether or not the amount of recirculating stock in the system is permitted to decrease during a machine shutdown as described above, conditions in first receiver 10, dropleg 50 and second receiver 44 will remain substantially constant. Thus, so long as pump 54 continues to force deaerated stock upwardly through riser 68 and so long as vacuum source 16 continues to operate, cleaners 18 will continue to operate in substantially the same fashion as in normal operation with the papermaking machine running. Deaerated stock will be produced in first receiver 10 and will pass to second receiver 44 as in normal operation. The pond of deaerated stock in second receiver 44 will be maintained at approximately its normal level. There will be continued circulation of stock throughout the system, except in the relatively short conduits 72, 78 and 84 and the associated elements of the system. Such continued circulation will inhibit segregation of stock in the major portion of the system. Thus, the major portion of the system will be in substantially the same state as in normal operation.

When the papermaking machine is restarted, valve 74 is reopened and pump 70 is restarted, thus restoring circulation in conduits 72 and 78, manifold 80 and balancing line 84. Because the stock pond in second receiver 44 is already at normal operating level before the machine is restarted, stock will be supplied under normal operating pressure at manifold 80 as soon as valve 74 is reopened and pump 70 is restarted. Any minor amount of segregated stock in conduits 72, 80 and 84 will be rapidly recirculated and remixed. Thus, almost immediately after the papermaking machine is restarted, the system will supply stock to the machine under normal conditions, and acceptable paper can be made almost immediately after restarting the machine. As the papermaking machine begins to operate and the flow of white water to tank 34 resumes, valve 62 is reopened to restart the flow of makeup stock and maintain the consistency of the blend stock entering suction line 58.

In a variant of the partial shutdown procedure, valve 74 remains open and pump 70 continues to run at a reduced speed and boost when operation of the papermaking machine is interrupted. Valve 82 is throttled (partially closed) and valve 86 is set wide open, so that the pressure of stock in manifold 80 is less than that required to lift the stock upwardly through conduits 100 to headbox 96. In this condition, pump 70 merely forces stock through supply line 78, headbox manifold 80 and return conduit 84, back into second receiver 44, without transferring any of such stock to the papermaking machine and without effecting any net withdrawal of stock from second receiver 44. Thus, there is no stagnation in manifold 80 and in the associated piping. In other respects, operation in this fashion is identical with operation as described above.

In a further variant, conduits 100 may be provided with individual shutoff valves (not shown). These may be closed to interrupt transfer of stock from manifold 80 to headbox 96 while maintaining pump 70 and the remainder of the deaeration system in operation.

The system can also operate without any stock flow through cleaners 18 and first receiver 10. For such operation, pump 54 and vacuum source 16 are shut down, valves 66 and 62 are closed and valve 107 is opened. As in normal operation, pump 70 draws stock from second receiver 44 via suction line 72, and the major portion of such stock is transferred to headbox 96. However, as no stock enters second receiver 44 via dropleg conduit 50, the level of stock in receiver 44 decreases until it is approximately equal to the level of fluid in chamber 38, whereupon check valve 105 opens. The white water produced by the papermaking machine drains back into tank 34 as in normal operation. White water passes from tank 34 into chamber 38 via opening 42 and from such chamber through port 103 into second receiver 44. In second receiver 44, the white water blends with makeup stock introduced via diversion line 106 to provide stock of the desired consistency for introduction into suction line 72. In this mode of operation, the system does not clean or deaerate the stock supplied to the machine, and thus does not provide the improved quality and efficiency effected by cleaning and deaeration. However, the papermaking machine can still be utilized productively during repair or modification of the cleaners and first receiver.

As noted above, there is no pond of deaerated stock within the enclosed first receiver 10. Accordingly, the interior surfaces of such receiver are contacted only by rapidly flowing stock, such as the stock issuing from spray pipes 24 and the stock flowing along the bottom of the receiver towards conduit 50. The interior of the receiver is continually scoured by the moving stock. Such scouring inhibits formation of deposits within the first receiver and thereby minimizes the need for manual cleaning of the first receiver.

As illustrated in FIG. 4, apparatus according to a second embodiment of the present invention includes a wire pit or tank 134, overflow chamber 138 and second receiver 144. The apparatus also includes a pump 154 arranged to take stock from tank 134 via a suction pipe 156 and force such stock upwardly through a riser 168 to the first or vacuum receiver by way of cleaners and spray pipes. In these and other respects, the apparatus is similar to that described above with reference to FIGS. 1–3. However, in the embodiment of FIG. 4, the common wall 140 between overflow chamber 138 and tank 134 is provided with an extension 141 adjacent the bottom of the tank. Extension 141 defines a further portion of overflow chamber 138 extending along the bottom of tank 134, the width of such portion diminishing progressively towards opening 142. Opening 142 is directly aligned with the opening 155 of suction pipe 156, and such openings are adjacent one another. As recycle stock from chamber 138 passes through the progressively narrowing portion of the overflow chamber, it is progressively accelerated until it issues as a rapidly-moving jet from opening 142, and passes directly into the opening 155 of the suction pipe. This arrangement tends further to minimize fluctuations in the ratio of white water or return fluid to recycle stock in the blend drawn into suction pipe 156. A makeup line 158 extends into tank 134 from the makeup stock supply (not shown), the open end of makeup line 158 also being disposed immediately adjacent opening 155 of the suction pipe. In a variant of this approach, the extension of the overflow chamber may extend all the way across the tank to the opening of the suction pipe, and may be provided with a nozzle extending into the suction pipe.

Figure 5:
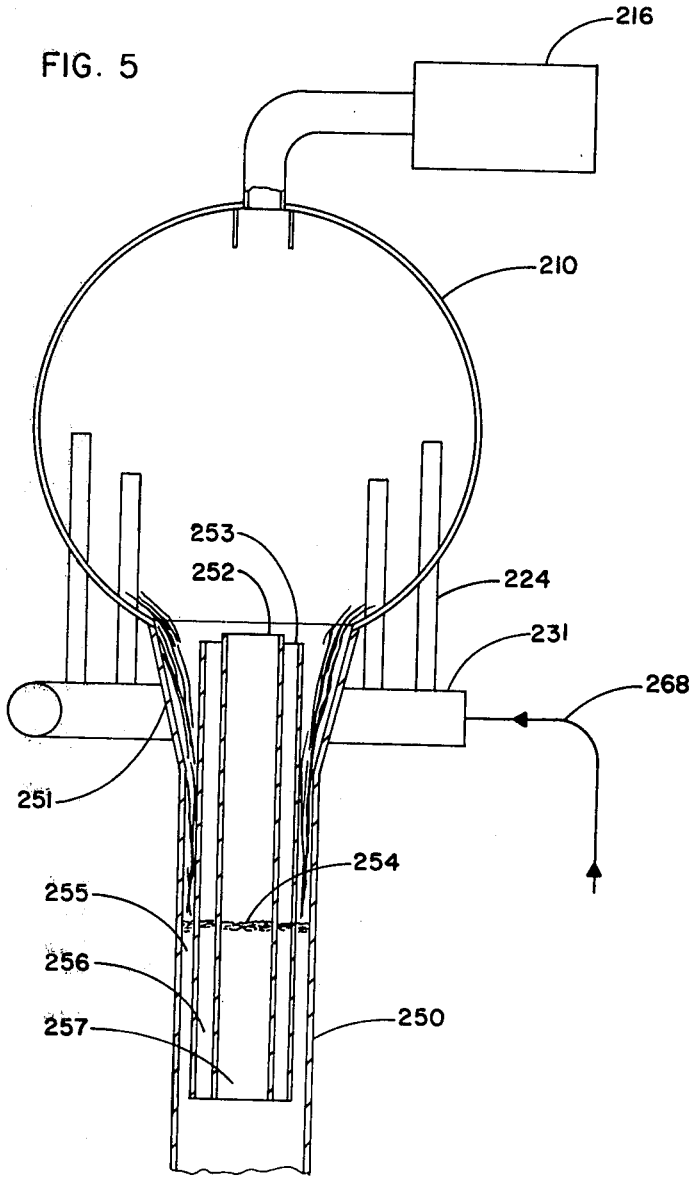
FIG. 5 is a fragmentary sectional view illustrating portions of apparatus according to a third embodiment of the present invention.
Figure 6:
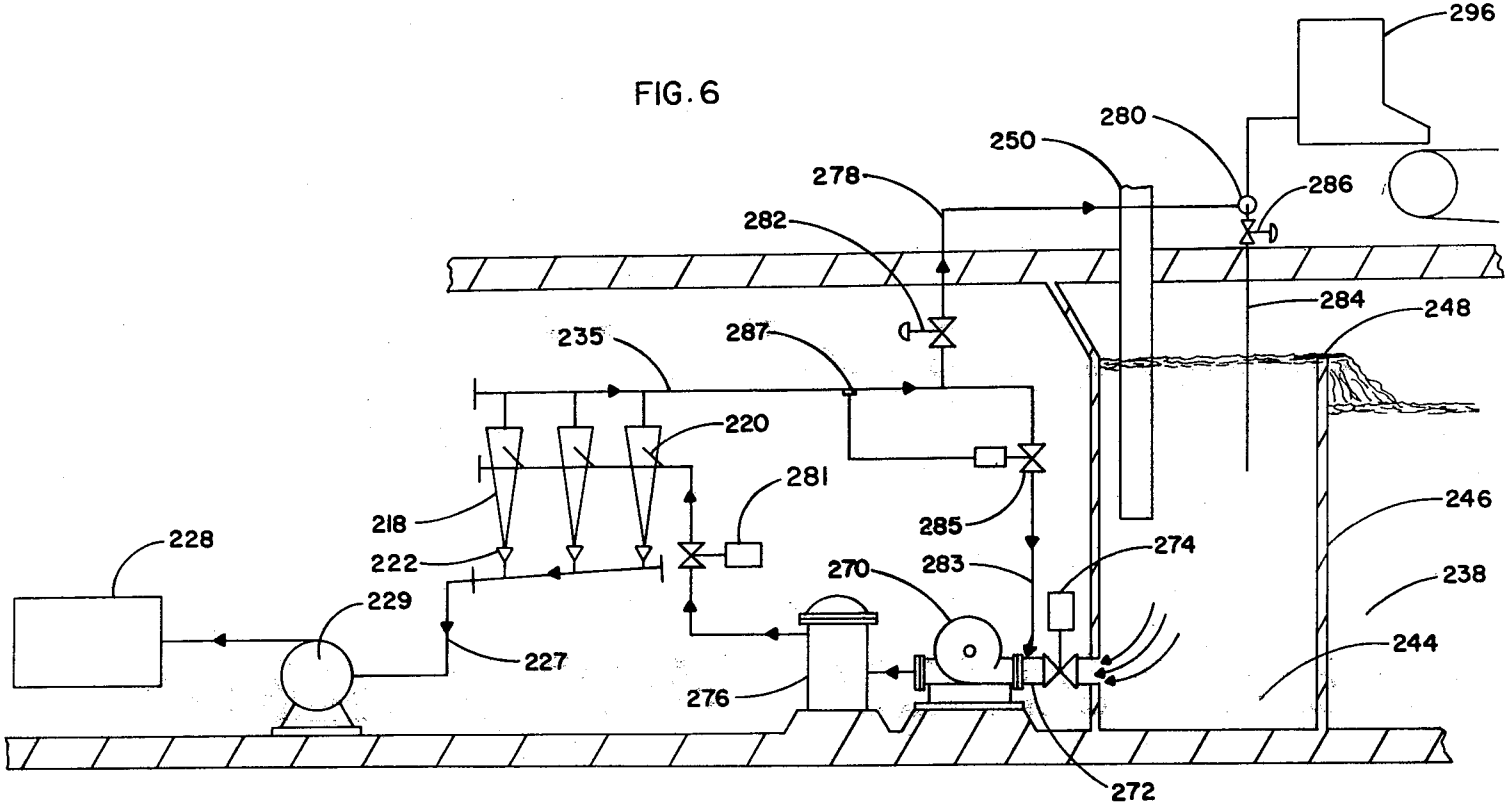
FIG. 6 is a fragmentary schematic view illustrating other portions of the apparatus illustrated in FIG. 5.

In apparatus according to a third embodiment, illustrated in FIGS. 5 and 6 the first receiver 210 is a unitary cylindrical vessel, the vacuum source 216 being connected to the vessel adjacent the top thereof. The barometric dropleg or conduit 250 extends downwardly from the bottom of first receiver 210 into second receiver 244 (FIG. 6). A pump (not shown) is arranged to take stock from the tank (not shown) and force it upwardly through a riser 268 (FIG. 5), these components being similar to the corresponding components of the apparatus described above with reference to FIGS. 1–3. Riser 268 is connected to spray pipes 224 via a manifold 231. Spray pipes 224 are arranged in banks along the length of cylindrical first receiver 210, one such bank being visible in FIG. 5. The spray pipes extend upwardly through the bottom wall of the tank, i.e., through the lower portion of the cylindrical tank wall, and discharge stock upwardly into the first receiver. In this arrangement, stock taken from the tank is introduced into the first receiver without passing through any intervening cleaners or hydrocyclones.

Deaerated stock produced in first receiver 210 passes downwardly via dropleg 250. Dropleg 250 is connected to receiver 210 via a conical transition piece 251 extending from the bottom of the receiver. The dropleg is equipped with flow-guiding elements of the type described in U.S. Pat. No. 4,219,340, issued Aug. 26, 1980 to Robert G. Kaiser. Two pipes 252 and 253 are concentrically disposed within the upper portion of dropleg 250 and transition piece 251, these pipes being supported by brackets (not shown). The lower ends of pipes 252 and 253 are disposed below the normal level of the top 254 of the fluid column in conduit 250. The upper end of innermost pipe 252 protrudes slightly above the end of pipe 253.

Transition piece 251 and pipes 252 and 253 define separate flow courses 255, 256 and 257 adjacent the upper end of the dropleg. Stock passing into the dropleg will pass preferentially via course 255. When the flow rate is sufficient to fill course 255 completely with downwardly flowing stock, the level of stock in transition piece 251 will rise above the top of pipe 253 and stock will begin to flow downwardly through course 256. If the flow rate increases further so that course 256 is completely filled, stock will begin to flow through course 257. Discharge of stock from the receiver to the dropleg in this fashion, with sequential filling of separate flow courses, minimizes pulsation in the dropleg and thus minimizes noise in operation of the system. Other arrangements defining multiple flow courses having entry at different levels may be utilized in place of the concentric pipes illustrated in FIG. 5.

Although the sequential filling of multiple flow courses described above may entail accumulation of stock in transition piece 251 at the bottom of receiver 210, the volume of stock which is accumulated in this fashion is negligible as compared with the volume of the receiver. Thus, the advantages arising from elimination of the pond in the vacuum receiver are still substantially preserved even when such a minor accumulation is employed.

One such advantage is believed apparent from FIG. 5. The distance between the upper ends of spray pipes 224 and the top wall of receiver 210 is selected so that stock discharged from the spray pipes will impinge on the wall in the desired pattern for effective deaeration. If a large pond were maintained in the bottom of receiver 210 for pressure control purposes, the receiver would have to be of greater diameter and the spray pipes would have to be longer to provide the desired juxtaposition between their upper ends and the top wall of the receiver. In other words, substantial elimination of the pond permits the use of shorter spray pipes in this apparatus. Such shorter spray pipes offer less resistance to stock flow and hence save energy in operation.

The downwardly flowing stock in dropleg 250 passes into second receiver 244 (FIG. 6). The level of stock in second receiver 244 is maintained substantially constant by a weir, the crest 248 of such weir being the top of common wall 246 separating second receiver 244 from overflow chamber 238. Second receiver 244 is connected to a headbox pressure pump 270 via a suction conduit 272 opening into second receiver 244 adjacent the bottom thereof, a shutoff valve 274 being provided adjacent the inlet to conduit 272. Headbox pressure pump 270 is connected through a screen 276 and a control valve 281 to the inlets 220 of hydrocyclones or cleaners 218. The reject outlets 222 of the cleaners are connected, via a rejects manifold 227 and a pump 229, to additional cleaning stages 228. A source of dilution water (not shown) is also connected to the additional cleaning stages. The accept outlets of cleaners 218 are connected to an accepts manifold 235, which in turn is connected via valve 282 and headbox supply line 278 to headbox manifold 280. Accepts manifold 235 is also connected to a return line 283 leading back into suction pipe 272, return line 283 being provided with a control valve 285 actuated by a pressure sensor 287 connected to accepts manifold 235. The end of headbox manifold 280 opposite its connection with supply line 278 is connected to a balancing conduit 284 leading back to second receiver 244 via a valve 286.

Stock withdrawn from second receiver 244 is transferred to the headbox 296 of the papermaking machine via the cleaners 218. When the setting of valve 282 in headbox supply line 278 is reset, as when changing the grade of paper being produced, control valve 285 adjusts the return flow through conduit 283 to maintain the pressure in accepts manifold 235 at a preselected optimum value for efficient operation of cleaners 218. However, sensor 287 and control valve 285 are relatively slow response components and these components are not utilized to compensate for momentary pressure fluctuations in the accepts manifold. Instead, the constant level pond in second receiver 244 prevents substantial fluctuations in stock pressure at the inlet to pump 270 so that the pressure in accepts manifold 235 may be maintained free of such fluctuations.

During a temporary shutdown of the papermaking machine, valve 282 may be closed so that headbox supply pump 270 merely forces stock around an endless loop through cleaners 218 and return line 283. In such operation, the headbox supply pump will draw from second receiver 244 only a minor amount of stock, sufficient to compensate for the loss of stock through the reject outlets of cleaners 218. The remainder of the system will continue to operate, with stock continually spilling over weir crest 248, passing back to the first receiver and back again to second receiver 244.

Alternatively, valve 274 may be shut and the power to pump 270 may be interrupted, while keeping the remainder of the system in operation. Thus, during a temporary shutdown of the papermaking machine, stock will circulate through the second receiver, overflow chamber, tank and first receiver, but there will be no circulation through the cleaners.

Figure 7:
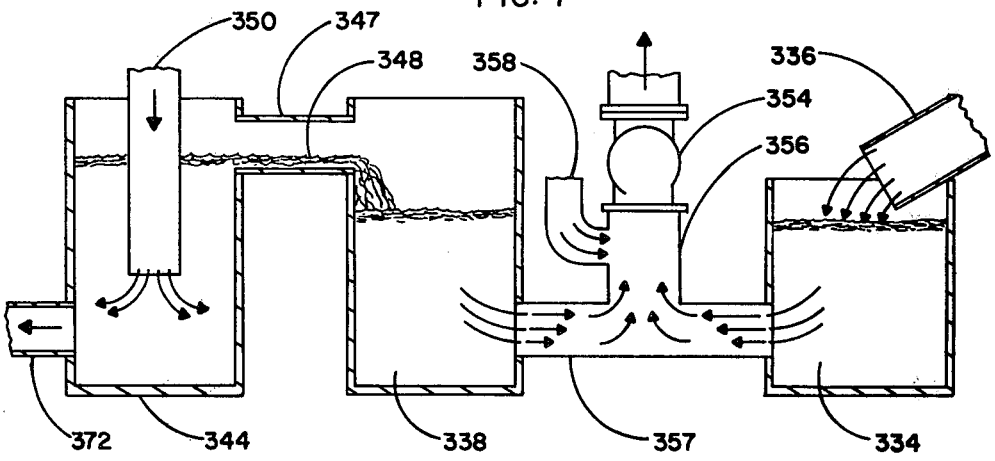
FIG. 7 is a fragmentary schematic view illustrating portions of apparatus according to a fourth embodiment of the present invention.

In apparatus according to a fourth embodiment of the invention, illustrated in FIG. 7, second or open receiver 344, overflow chamber 338 and tank 334 are not separated from one another by common walls. Instead, these vessels are formed separately from one another. All of these vessels are open to the atmosphere and are disposed adjacent one another. Second receiver 344 is connected to overflow chamber 338 by a pipe 347 mounted adjacent the top of receiver 344, the lower wall 348 of such pipe constituting a weir crest or spillway for discharge of recycle stock from second receiver 344. A pump 354 is provided for taking stock from tank 334 and forcing it upwardly to the first receiver (not shown). Overflow chamber 338 is not connected to the inlet of pump 354 by way of tank 334. Instead, both tank 334 and overflow chamber 338 are connected to the suction line 356 of pump 354 via a tee connection 357. The makeup stock supply line 358 is directly connected to suction line 356. Tank 334 is not disposed directly under the papermaking machine. A conduit 336 extends from the papermaking machine to the top of tank 334, white water or return fluid from the papermaking machine being conducted to the tank via such conduit.

The system operates in substantially the same fashion as the system described above with reference to FIGS. 1—3. Thus, deaerated stock produced in the first receiver is conducted to second receiver 344 via a barometric dropleg 350, the major portion of such deaerated stock being transferred to the papermaking machine via conduit 372 and a pump (not shown) associated therewith. A recycle portion of the deaerated stock spills out through pipe 347 into overflow chamber 338, thus maintaining the level of stock within second receiver 344 substantially constant. Recycle stock from overflow chamber 338, return stock or white water from tank 334 and makeup stock from line 358 are forced back into the first receiver via cleaners and spray pipes (not shown) by pump 354.

This arrangement may be utilized, for example, in new installations where the second receiver and overflow chamber are prefabricated vessels made away from the mill and shipped to the mill for installation. This arrangement may also be used with so-called "silo-type" papermaking installations equipped with tanks or white water receiving vessels disposed at one side of the machine rather than beneath the machine.

Figure 8:
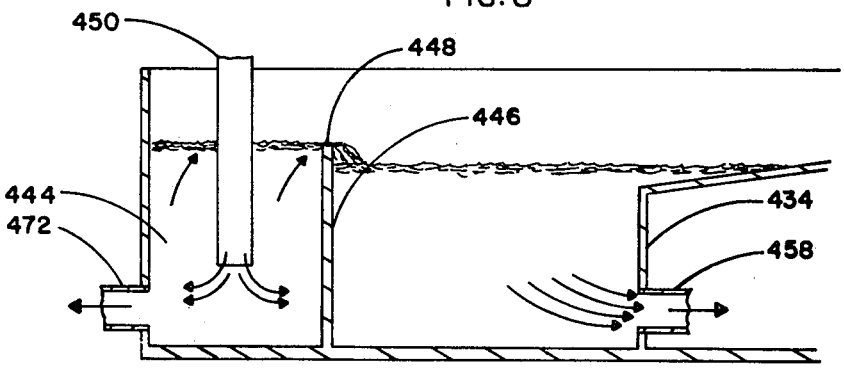
FIGS. 8, 9 and 10 are views similar to FIG. 7 depicting portions of apparatus according to further embodiments of the present invention.

As illustrated in FIG. 8, apparatus according to a fifth embodiment of the present invention incorporates a tank 434 similar to the tank illustrated in FIG. 1. This apparatus also includes an open second receiver 444 adjacent tank 434. However, there is no separate overflow chamber intervening between the second receiver and the tank. Rather, these vessels are separated from one another by a common wall 446 serving as a weir, the top edge of 448 of such common wall serving as the crest of the weir. Recycle stock overflowing weir crest 448 drops directly into tank 434 wherein the recycle stock and the white water or return fluid in tank 434 blend with one another. A pump arrangement (not shown) similar to those described above is provided for taking the blended stock from tank 434 via suction line 458 and introducing such stock into the first receiver (not shown) to produce deaerated stock, which returns to second receiver 444 via dropleg 450. Second receiver 444 is connected to the papermaking or processing machine via conduit 472.

The operation of this apparatus is similar to the operation of the apparatus described above with reference to FIGS. 1—3. Because the apparatus of FIG. 8 does not incorporate an overflow chamber and does not provide for introduction of the recycle stock into the bottom of the tank, the consistency of the blend stock taken from the tank may vary somewhat if the flow pattern in tank 434 fluctuates. However, stock taken from tank 434 at various times will be mixed in the other components of the apparatus, as in second receiver 444, before the stock reaches the papermaking machine. Such mixing tends to mask fluctuations in the consistency of the stock drawn out of the tank via line 458.

Figure 9:
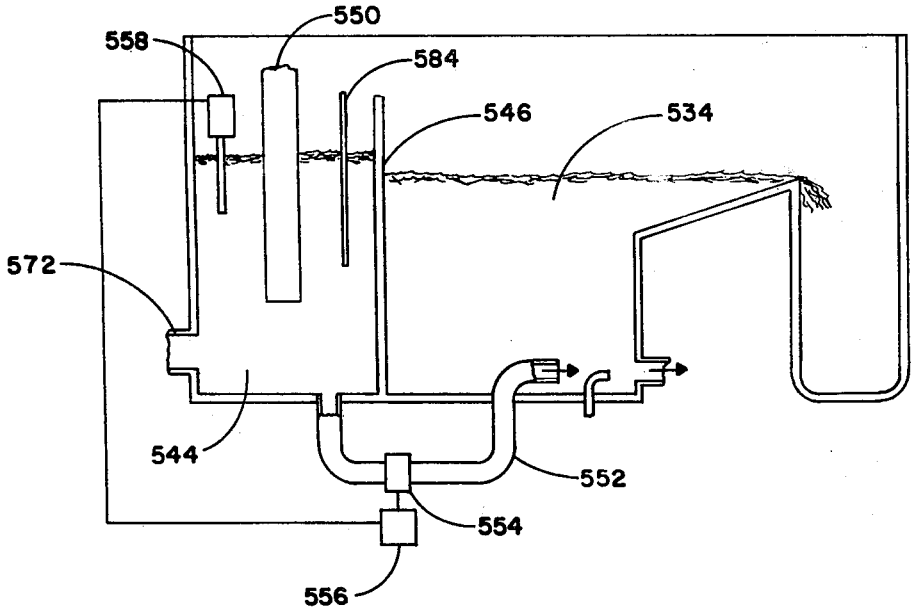

The apparatus illustrated in FIG. 9 includes a second receiver 544, a tank 534 and a dropleg conduit 550 extending into the second receiver. However, there is no level-controlling weir associated with second receiver 544. A bypass line 552 interconnects receiver 544 and tank 534, such bypass line being provided with a valve 554. Valve 554 is linked to actuator 556, which in turn is connected to a level sensor 558, arranged to detect the level of stock in second receiver 544. These components are interconnected in a feedback loop arrangement so that an increase in the stock level above a predetermined "set point" level causes valve 554 to open wider and a decrease in such stock level below the set point level causes such valve to close somewhat. The set point level is selected (by adjustment of sensor 558) so that it is well above the level of fluid in tank 534.

In normal operation, deaerated stock flows into receiver 544 via dropleg conduit 550 from an enclosed vacuum receiver (not shown). Stock is withdrawn from receiver 544 via conduit 572 and transferred to the papermaking machine, a portion of such stock being returned to receiver via balancing line 584. The net rate of withdrawal (the rate of outflow via conduit 572 less the rate of return flow via conduit 584) is less than the average rate of stock introduction via dropleg conduit 550. Thus, stock tends to accumulate in receiver 544. A recycle portion of such stock discharges through bypass line 552 into tank 534. The feedback loop arrangement controls the rate of such discharge by varying the opening of valve 554 so as to maintain the level of stock in the second receiver close to the set point level. For example, if the rate of inflow via dropleg 550 increases momentarily, the level in the receiver also tends to increase, but valve 554 opens wider to increase the rate of discharge via bypass line 552 and thereby counteract such tendency.

The degree of regulation achieved by this system will depend in large measure upon the sensitivity and speed of response of the feedback loop components. Bypass line 552 and valve 554 must be large enough in diameter to permit substantial rates of stock discharge as may be required in the event of substantial momentary increases in inflow via dropleg 550 during normal operation or in the event of a temporary shutdown of the papermaking machine. During such a shutdown, all of the stock flowing through the dropleg would discharge via the bypass line. The size required to accomodate any particular discharge rate will depend upon the difference between the set point level in receiver 544 and the fluid level in tank 534. However, for a typical system, the bypass line and valve may be a foot (30 cm) or more in diameter. A small "vernier" valve may be connected in parallel with such a large valve, and the control components may be arranged to compensate for small deviations in the pond level by adjusting only the vernier valve.

In a hybrid version of the apparatus illustrated in FIG. 9, the common wall 546 between second receiver 544 and tank 534 serves as a weir, and such weir is utilized as an additional or "backup" system for controlling the stock level in receiver 544. The set point level of the feedback control system is selected so that it is just slightly below the level of the weir crest. The feedback control system and bypass line compensate for minor fluctuations in the inflow rate via the dropleg and maintain the pond in the second receiver at approximately the set point level. Upon a major surge in the dropleg flow rate, or upon a temporary shutdown of the papermaking machine, stock spills over the weir.

Figure 10:
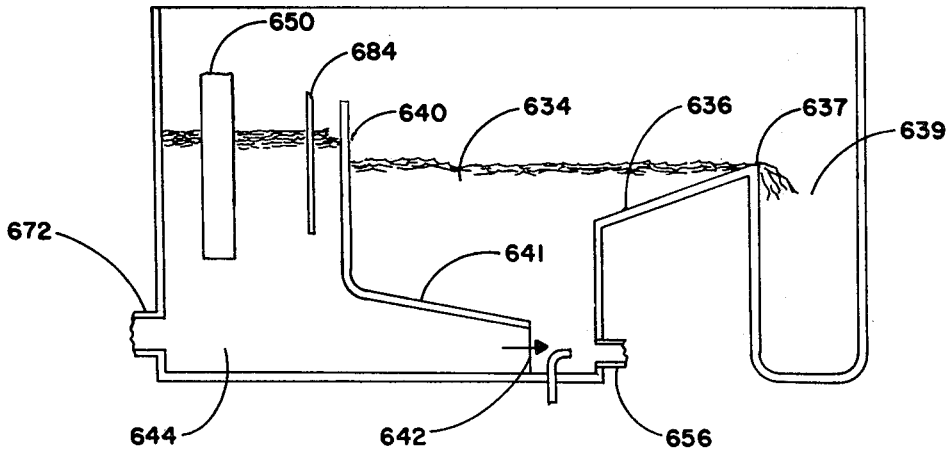

The apparatus of FIG. 10 incorporates a first or vacuum receiver (not shown), a dropleg conduit 650, a second receiver 644 and a conduit 672 for withdrawing stock from receiver and transferring such stock to the papermaking machine (not shown), there being a balancing line 684 for returning a portion of the withdrawn stock. This apparatus also includes a wire pit or tank 634 having a ramp 636. Tank 634 is connected via suction line 656 to a pump (not shown) which takes stock from the tank and passes it to the vacuum receiver. In these and other respects, this apparatus is similar to that described above with reference to FIGS. 1–3. However, receiver 644 is connected to tank 634 through an extension 641 adjacent the bottom of tank 634 and an opening 642 at the end of such extension, opening 642 being adjacent the opening of suction line 656.

In normal operation, white water continually spills over the upper end 637 of ramp 636 into couch pit 639, thus maintaining the level of white water in tank 634 substantially constant. Deaerated stock flows from the first or vacuum receiver into second receiver 644 via dropleg 650 at an average rate greater than the net rate at which stock is withdrawn from receiver 644 and transferred to the papermaking machine. A recycle portion of the deaerated stock is discharged from the second receiver into the tank via opening 642. As the discharged stock flows through tapered extension 641, it is gradually accelerated so that issues as a rapidly-flowing jet from opening 642, such jet passing directly into the opening of suction line 656.

The pond of deaerated stock accumulates in receiver 644 to an equilibrium level at slightly above the level of the white water in tank 634. At such equilibrium level, the rate of discharge through opening 642 due to the difference in head or pressure between the two vessels is equal to the difference between the average rate of inflow through dropleg 650 and the net rate of stock transfer from receiver 644 to the papermaking machine.

A momentary increase in flow through dropleg 650 tends to raise the stock level in receiver 644, which increases the difference in pressure between the receiver and tank 634 and thus increases the rate of discharge through opening 642. Such increased rate of discharge tends to restore the stock in the receiver to its equilibrium level. Decreased inflow through dropleg 650 of course has the reverse effect, and is compensated for by a decrease in the discharge through opening 642.

In a variant of this apparatus, the common wall 640 between second receiver 644 and tank 634 may serve as a weir. The height of such weir may be selected so that some of the recycle stock continually spills over the weir. Alternatively, the weir crest may be disposed slightly above the normal pond level in receiver 644, so that stock spills over the weir only in the event of a major surge in flow through dropleg 650 or in the event of a processing machine shutdown.

Deaerated stock supply systems according to the present invention may be installed in a mill which already has a preexisting vessel serving as a white water collection tank or wire pit. In making such an installation, the second receiver, overflow chamber or both may be formed by subdividing such pre-existing vessel. For example, the second receiver 444 illustrated in FIG. 8 may be made simply by installing a wall within the preexisting vessel to subdivide such vessel into a tank portion and a receiver portion. Likewise, the receiver and overflow chamber illustrated in FIG. 1 may be installed by installing wall 46 within the preexisting vessel to form second receiver 44 and installing a further wall or baffle 40 within the preexisting vessel to define the overflow chamber. In a further modification, the overflow chamber may be made by installing the appropriate wall or baffle within the preexisting vessel and the second receiver may be fabricated separately, such separate receiver being connected to the overflow chamber by a pipe or spillway similar to the pipe 347 illustrated in FIG. 7.

Fabrication of the second receiver, the overflow chamber, or both by subdivision of a preexisting vessel in this fashion is most advantageous. It avoids the cost of constructing entirely new vessels; some portions of the preexisting vessel wall structure serve as walls of the receiver or overflow chamber. Moreover, the new walls which must be installed may be of relatively light construction and inexpensive. For example, in the apparatus illustrated in FIG. 1, the stock levels in overflow chamber 38 and tank 34 will differ only slightly. Thus, wall 40 need not withstand any substantial difference in head or pressure, and need not have the strength required to withstand such a pressure difference.

Use of the space within the preexisting vessel conserves space within the mill. This is a major advantage, inasmuch as it may avoid interference with other preexisting machinery in the mill. As will be appreciated, subdivision of a preexisting vessel in this fashion reduces the volume of the vessel available for service as a white water collection vessel. It is generally desirable to leave the remaining white water collection vessel or tank, after such subdivision, with enough volume and plan area that the outflow of fluid at the bottom of the tank to the pump does not produce rapid downward flow of white water in all regions of the tank. Rather, a gradual downward flow or settling in the upper region of the tank is desirable. Such gradual downward flow permits relatively large, gross entrained air bubbles in the white water or return fluid to rise upwardly to the surface against the flow. This action purges some of the air from the fluid before it reaches the first receiver, thereby reducing the load on the vacuum system and promoting effective deaeration. If the preexisting vessel is already so small that the settling velocity is marginal, it may be necessary to enlarge such vessel before subdividing it. To conserve space and minimize installation costs, the preexisting vessel may be enlarged by only the minimum required to provide a tank of adequate size and the major portion of the preexisting vessel walls may be left intact.

Figure 11:
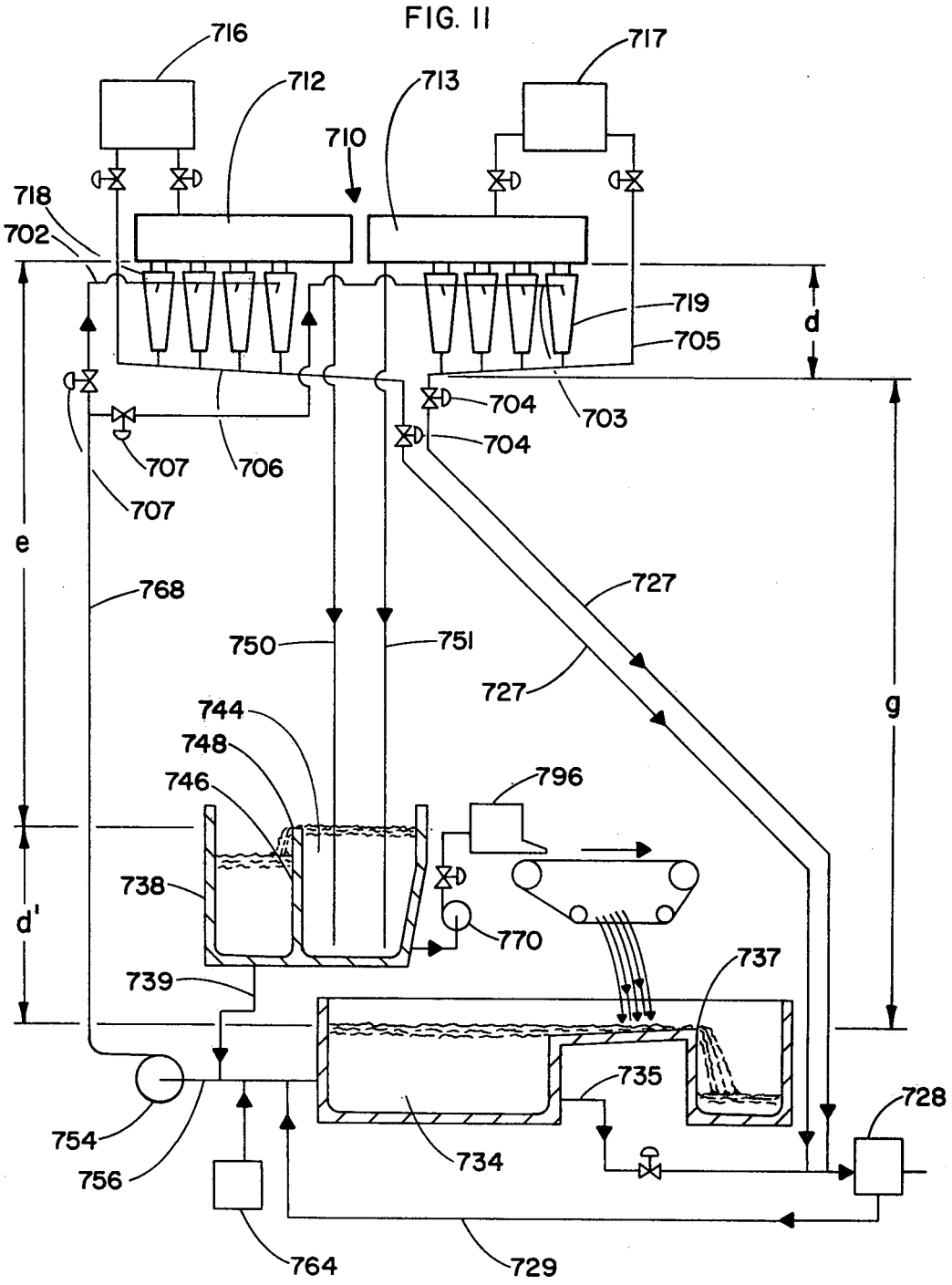
FIG. 11 is a schematic view depicting apparatus according to another embodiment of the present invention.

In the apparatus illustrated in FIG. 11, the first or vacuum receiver 710 consists of two separate vessels 712 and 713 which are not connected to one another. A vacuum source 716 is connected to vessel 712 and a separate vacuum source 717 is connected to vessel 713.

Hydrocyclones 718 are disposed beneath vessel 712, the feed inlet of each such hydrocyclone being connected via an inlet manifold 702 to the riser 768 which carries stock to be deaerated. The accept outlet of each hyydrocyclone 718 is connected to a spray pipe extending into vessel 712 and the reject outlet of each such hydrocyclone is connected to a reject manifold 706. A similar but separate arrangement of hydrocyclones 719, inlet manifold 703 and reject manifold 705 is associated with vessel 713. Deaerated stock produced in vessel 712 is conducted downwardly to the second receiver 744 via a first dropleg conduit 750 and deaerated stock from vessel 713 passes to the second receiver via another dropleg conduit 751. Conduits 750 and 751 are not connected to one another.

Second receiver 744 is provided with a weir 746, recycle stock spilling over the crest 748 of such weir into overflow chamber 738 so as to maintain the level of the stock pond in receiver 744 substantially constant. Deaerated stock is drawn from second receiver 744 and passed to headbox 796 of the papermaking machine by pump 770. Recycle stock passes from overflow chamber 738 via a short conduit 739 to the suction pipe 756 of pump 754, where the recycle stock blends with white water from tank 734 and makeup stock from source 764. To maintain the pond in second receiver 744, the average rate of inflow to such receiver via conduits 750 and 751 must be greater than the average rate of transfer to headbox 796. Thus, the average rate at which deaerated stock is produced in first receiver 710—the sum of the average production rates of vessels 712 and 713—must be greater than the rate of transfer to the headbox.

Use of separate conduits with separate vessels constituting the first or vacuum receiver provides several distinct advantages. First, the open second receiver 744 minimizes transmission of fluctuations or pulsations between conduit 750 and conduit 751 and thereby isolates the two vacuum vessels 712 and 713 from one another. As there can be no cross flow between vessels 712 and 713, minor imbalances in pressure or flow between these vessels will not seriously impair system operation.

The two vessels may be operated independently of one another. Shutoff valves 707 are interposed between riser 768 carrying stock to be deaerated and the inlet manifolds 702 and 703. Likewise, shutoff valves 704 are interposed between reject manifolds 705 and 706 and the reject downfeed conduits 727 carrying reject stock from the reject manifolds to additional cleaning stages 728. Vessel 712 and hydrocyclones 718 may be isolated from the remainder of the system by closing appropriate ones of the shutoff valves 704 and 707, and vessel 713 can be isolated in similar fashion. This permits continued operation of the cleaning and deaeration system and continued operation of the associated papermaking machine (at reduced capacity) while part of the system is shut down for maintenance.

Another significant advantage of this multiple vessel, multiple conduit arrangement is that additional vessels and dropleg conduits may be installed as required to increase the capacity of the system. Additional capacity can be added without replacing existing components even if no provision was made for such addition in the original installation. Thus, vessel 712, dropleg conduit 750 and the associated hydrocyclones and manifolds may be installed at one time and vessel 713 with its associated components may be installed at a later time when the paper making machine is modified to increase its capacity and hence increase its demand for deaerated stock. Because the two vacuum receivers are effectively isolated from one another, the connection of the second vacuum receiver into the system in this fashion will not create problems of balance between the two receivers such as may occur when multiple receivers are connected to a common dropleg conduit. Of course, additional vacuum vessels beyond the two illustrated in FIG. 11 may be added in similar fashion.

There is no need to provide sufficient flow capacity in the dropleg conduit of the initial installation to accomodate the total flow from additional vessels which may be added at a later date. There is thus no need to make the first installed dropleg conduit of greater diameter than required for its original purpose. This is a significant advantage in that, if the first installed dropleg conduit must be oversized as originally installed, the flow velocity in such conduit will be lower than desirable and there may be some settling or segregation of stock within such conduit.

In the apparatus of FIG. 11, the reject manifolds 705 and 706 are connected to vacuum sources 716 and 717 so that the reject manifolds may be maintained under vacuum during operation of the apparatus. The reject manifolds are only partialy filled with flowing liquid reject stock, so that the vacuum in the manifolds is applied to the reject outlets of hydrocyclones 718 and 719. This arrangement promotes efficient operation of the hydrocyclones and also promotes effective deaeration of the processed stock. To prevent complete filling of the reject manifolds, the top of the fluid columns in reject downfeed conduits 727 must be maintained below the manifolds 705 and 706.

The reject stock flowing from manifolds 705 and 706 via reject downfeed conduits 727 is of relatively high fiber content or consistency. White water drawn from tank 734 via line 735 is blended with such stock prior to its introduction into additional cleaning stages 728 to reduce the consistency of the reject stock for treatment in the additional cleaning stages. The major portion of the reject stock sent to the additional cleaning stages is reclaimed and passed back to stock introducing pump 754 via reclaim line 729. The level of white water in tank 734 is maintained substantially constant by discharge of some white water over the end 737 of the associated ramp. The white water in tank 734 is under atmospheric pressure, and the reject manifolds 705 and 706 are under vacuum or subatmospheric pressure. To permit downward flow in conduits 727, the column of reject stock in each such conduit must have sufficient head to overcome this difference in pressure. Thus, the bottom of each reject manifold should be at an elevation g above the level of the white water in tank 734 slightly greater than the height of the fluid column required to overcome the pressure difference.

The deaerated stock flowing from vessels 712 and 713 of first receiver 710 to second receiver 744 via dropleg conduits 750 and 751 must overcome a similar pressure difference between the vacuum in the first receiver and the atmospheric pressure on the pond of stock in the second receiver Thus, the vessels of first receiver 710 should be at a similar elevation e above the level of the pond in second receiver 744.

Vessels 712 and 713 of first receiver 710 are disposed above the hydrocyclones 718 and 719, whereas reject manifolds 705 and 706 are disposed beneath the hydrocyclones. Thus, first receiver 710 is at a somewhat higher elevation than the reject manifolds. This difference in elevation is especially pronounced where the bodies of the hydrocyclones 718 and 719 are oriented vertically. Depending on the particular hydrocyclones and piping employed, this difference in elevation d may be on the order of 10 feet (3 meters).

Second receiver 744 is mounted at a higher elevation than tank 734, and weir 746 is arranged so that the pond level in the second receiver is elevated above the white water level in tank 734 by a distance d′ approximately equal to the difference in elevation d between the reject manifolds and the vessels of the first receiver. Thus, the elevation or the vertical distance e between the vessels of the first receiver and the pond level will be approximately equal to the vertical distance g between the reject manifolds and the white water level, both of such distances being just slighty more than required to overcome the pressure differences due to vacuum. This arrangement conserves pumping work and power in operation. If second receiver 744 were mounted at a lower elevation, and if the pond level were maintained just slightly above the white water level in tank 734, the apparatus would be effective, but pump 770 would have to do additional work in elevating the deaerated stock to the level of headbox 796.

In a variant of this approach, pump 770 may be entirely omitted, so that deaerated stock flows from the second receiver to headbox 796 by gravity. In a further variant, the second receiver may be mounted directly over tank 734 to save floor space in the mill.

As will be readily appreciated, numerous variations and combinations of the features described above may be utilized. For example, although a barometric dropleg provides the simplest means for conducting deaerated stock from the first receiver to the second receiver, a pump may be interposed between these receivers to assist the flow from the first receiver to the second receiver. If such a pump is utilized, the first receiver need not be elevated above the second receiver, as the pump will overcome the pressure difference between the evacuated first receiver and the atmospherically pressurized second receiver. Further, the cleaners or hydrocyclones may be omitted if the stock is cleaned by other equipment before it enters the system.

Although deaerated stock supply apparatus according to the present invention has been described above in conjunction with papermaking machinery, such apparatus can be utilized in conjunction with other machinery capable of utilizing deaerated stock. For example, a suspension of glass fibers in water may be supplied by the present apparatus to machinery for making mats and the like.

As these and other variations and combinations of the features described above may be utilized, the foregoing description of the preferred embodiments should be taken by way of illustration rather than by way of limitation of the present invention as set forth in the claims.

What is claimed is:

1. Apparatus for providing deaerated stock to a processing machine, said apparatus comprising:

(a) an enclosed first receiver;

(b) means for maintaining said first receiver under a vacuum;

(c) means for introducing stock into said first receiver to thereby produce deaerated stock in said first receiver at a predetermined average production rate;

(d) stock supply means for supplying stock to be deaerated to said introducing means;

(e) a second receiver open to the atmosphere;

(f) means for conducting deaerated stock from said first receiver to said second receiver;

(g) means for withdrawing stock from said second receiver at a net rate of withdrawal lower than said average production rate, so that stock accumulates as a pond in said second receiver, said withdrawing means being operative to transfer the withdrawn stock to the processing machine;

(h) level control means for discharging a recycle portion of deaerated stock from said second receiver and varying the rate of such discharge to maintain the pond of stock in said second receiver at a predetermined pond level, said conducting means being operative to discharge deaerated stock into said second receiver at an elevation below said predetermined pond level;

(i) recycle means for passing said recycle stock discharged by said level control means to said introducing means.

2. Apparatus is claimed in claim 1 wherein said stock supply means includes a tank and means for collecting said stock to be deaerated in said tank, said introducing means being operative to draw such stock from said tank, said first receiver being disposed remote from said tank, said second receiver being disposed adjacent said tank, said recycle means being connected to said introducing means in the vicinity of said tank.

3. Apparatus as claimed in claim 2 wherein said first receiver is disposed above said second receiver.

4. Apparatus as claimed in claim 3 wherein said conducting means includes a barometric dropleg extending from said first receiver to said second receiver, said vacuum-maintaining means being operative to maintain a column of stock in said dropleg so that the top of such column is below the bottom of the first receiver.

5. Apparatus as claimed in claim 4 in which said first receiver includes a plurality of separate vessels and a plurality of barometric droplegs extending from said vessels to said second receiver, there being one such dropleg for each of said vessels.

6. Apparatus as claimed in claim 2 wherein said recycle means is connected to said introducing means by way of said tank, said recycle means being operative to pass said recycle stock into said tank.

7. Apparatus as claimed in claim 6 wherein said stock supply means includes means for collecting in said tank a return fluid from the processing machine and means for supplying a makeup stock.

8. Apparatus as claimed in claim 7 wherein said collecting means is operative to introduce said return fluid into said tank adjacent the top thereof, said introducing means being operative to take stock from said tank at an outlet location adjacent the bottom of said tank, said recycle means being operative to pass said recycle stock into said tank at an inlet location adjacent the bottom thereof.

9. Apparatus as claimed in claim 8 wherein said inlet location and said outlet location are aligned with one another, said recycle means being operative to discharge the recycle stock into the tank at said inlet location as a stream directed towards said outlet location, said tank having a pair of opposed side walls sloping toward one another adjacent the bottom of the tank.

10. Apparatus as claimed in claim 8 wherein said inlet location is disposed adjacent said outlet location and aligned therewith and said recycle means includes means defining a flow course for the recycle stock to said inlet location, the cross-sectional area of such flow course diminishing toward said inlet location.

11. Apparatus as claimed in claim 8 wherein said means for supplying makeup stock includes means for discharging such stock into said tank adjacent said outlet location as a stream directed towards said outlet location.

12. Apparatus as claimed in claim 8 wherein said recyle means includes an overflow chamber juxtaposed with said tank and communicating therewith, said level control means being operative to direct recycle stock into said overflow chamber.

13. Apparatus as claimed in claim 12 wherein there is a common wall between said overflow chamber and said tank.

14. Apparatus as claimed in claim 12 wherein there is a common wall between said second receiver and said overflow chamber.

15. Apparatus as claimed in claim 14 wherein said level control means includes a weir and the common wall between said second receiver and said overflow chamber constitutes such weir.

16. Apparatus as claimed in claim 7 further comprising means for temporarily interrupting introduction of stock to said first receiver and means for passing stock from said tank to said second receiver during such interruption.

17. Apparatus as claimed in claim 2 further comprising means for temporarily interrupting transfer of stock to the processing machine by said withdrawing means, said level control means being operative to discharge recycle stock from said second receiver at a rate substantially equal to said average production rate during such interruption, said recycle means being operative to pass said recycle stock to said introducing means at a rate substantially equal to such production rate during such interruption to thereby maintain the remainder of the apparatus in operation.

18. Apparatus as claimed in claim 1 or claim 17 wherin said level control means includes a weir associated with said second receiver.

19. Apparatus as claimed in claim 18 wherein said level control means consists solely of said weir.

20. Apparatus as claimed in claim 17 wherein said level control means includes means for controlling the level of fluid in said tank so that such level is below said predetermined pond level in said second receiver and a passage interconnecting said second receiver and said tank below said predetermined pond level.

21. Apparatus as claimed in claim 20 wherein said level control means includes a valve in said passageway, means for detecting the level of the pond in said second receiver and means for adjusting said valve in response to changes in such level.

22. Apparatus as claimed in claim 17 wherein said withdrawing means includes a manifold disposed adjacent the processing machine and communicating therewith, means for passing stock from said second receiver to said manifold, and means for passing an unused portion of such stock back to a location in said second receiver below said predetermined pond level.

23. Apparatus as claimed in claim 17 wherein said interrupting means includes means for reducing the stock pressure within said manifold to prevent transfer of stock to the processing machine while maintaining stock circulation through said manifold.

24. Apparatus as claimed in claim 18 wherein the bottom of said first receiver is more than 34 feet above the crest of said weir.

25. Apparatus as claimed in claim 1 wherein said introducing means includes a plurality of spray pipes extending upwardly through the bottom of said first receiver.

26. Apparatus as claimed in claim 25 wherein said introducing means includes a plurality of hydrocyclones, each of said hydrocyclones having an accept outlet, the accept outlets of said hydrocyclones being connected to said spray pipes, each of said hydrocyclones having an elongated body, said hydrocyclones being disposed in a side-by-side array beneath said first receiver.

27. Apparatus as claimed in claim 26, further comprising a reject manifold disposed below said hydrocyclones and connected thereto for taking reject stock therefrom, a reject downfeed conduit extending downwardly from said reject manifold, a tank open to the atmosphere, means for maintaining fluid in said tank at a predetermined level and a connection between said reject downfeed conduit and said tank for mixing the fluid in said tank with the reject stock, said conducting means including a barometric dropleg extending from said first receiver to said second receiver, said predetermined pond level of stock in said second receiver being above the level of fluid in said tank.

28. Apparatus as claimed in claim 27 in which the vertical distance between said first receiver and the predetermined pond level of the stock in said pond is approximately equal to the vertical distance between said reject manifold and the level of stock in said tank.

29. A method of installing deaerated stock supply apparatus in a mill having a preexisting processing machine and an associated preexisting return fluid collection vessel, comprising the steps of:

(a) installing an enclosed first receiver and installing means for maintaining a vacuum in said first receiver;
(b) installing means for introducing stock into said first receiver;
(c) installing a first wall within said vessel so that said wall subdivides said vessel into a tank and a second receiver;
(d) connecting said first receiver to said second receiver and connecting said second receiver to said processing machine;
(e) installing means for controlling the level of stock in said second receiver by discharging recycle stock from such receiver; and
(f) installing recycle means for passing recycle stock to said stock-introducing means.

30. A method as claimed in claim 29 wherein said recycle means installing step includes the steps of installing a baffle in said vessel to define an overflow chamber therein and connecting said overflow chamber to said introducing means.

31. A method of installing deaerated stock supply apparatus in a mill having a preexisting processing machine and an associated preexisting return fluid collection vessel, comprising the steps of:

(a) installing an enclosed first receiver remote from said vessel and installing means for maintaining a vacuum in said first receiver;
(b) installing means for introducing stock into said first receiver;
(c) installing second receiver open to the atmosphere;
(d) connecting said first receiver to said second receiver, and connecting said second receiver to said processing machine;
(e) installing a baffle within said vessel so that said baffle subdivides said vessel into a tank and an overflow chamber;
(f) installing means for controlling the level of stock in said second receiver by discharging recycle stock from such receiver to said overflow chamber; and
(g) connecting said overflow chamber to said introducing means.

32. A method as claimed in claim 29 or claim 31 wherein said baffle is installed within said vessel so as to leave an opening between said overflow chamber and said tank adjacent the bottom of said vessel, thereby connecting said overflow chamber to said introducing means by way of said tank.

33. A method as claimed in claim 29 or claim 31 further comprising the step of enlarging said vessel, leaving at least a major portion of the preexisting boundary walls of said vessel intact.

34. A method as claimed in claim 29 or claim 31 wherein said vessel is not enlarged.

35. A method of supplying deaerated stock to a processing machine comprising the steps of:

(a) introducing stock into an enclosed first receiver and maintaining such receiver under a vacuum to thereby produce deaerated stock at a predetermined average production rate;
(b) conducting said deaerated stock to a second receiver open to the atmosphere and withdrawing deaerated stock from said second receiver and transferring the stock so withdrawn to the processing machine at a rate lower than said production rate, so that a pond of deaerated stock accumulates in said second receiver;
(c) discharging a recycle portion of such stock from said second receiver and varying the rate of such discharge to maintain the pond at a predetermined pond level, the stock conducted from said first receiver to said second receiver being discharged into said second receiver at a location below said pond level; and
(d) blending other stock to be deaerated with said recycle stock and passing the blended stock to said stock-introducing step.

36. A method as claimed in claim 35 in which the recycle stock is discharged from said second receiver over the crest of a weir associated with such receiver.

37. A method as claimed in claim 35 or claim 36 wherein at least a portion of the other stock to be deaerated is collected in a tank disposed adjacent said second receiver, and said recycle stock is blended with the collected stock in the vicinity of said tank.

38. A method as claimed in claim 37 further comprising the steps of temporarily interrupting said withdrawing step so that during such interruption the discharged recycle stock includes substantially all of the deaerated stock produced in said first receiver, temporarily interrupting said blending step concomitantly with interruption of said withdrawing step, and passing said recycle stock to said introducing step to thereby maintain continuous recirculation of deaerated stock during such interruption, and then restarting said withdrawing and blending steps.

39. A method as claimed in claim 38 wherein the same apparatus utilized to transport blended stock from the vicinity of said tank to said first receiver while said withdrawing and blending steps are operating is utilized to transport the recirculating stock while such steps are interrupted.

40. A method as claimed in claim 37 wherein said recycle stock is introduced into said tank.

41. A method as claimed in claim 40 wherein said recycle stock is introduced into said tank adjacent the bottom thereof and blended stock for said introducing step is drawn from said tank adjacent the bottom thereof.

42. A method as claimed in claim 41 in which said other stock to be deaerated includes a return fluid from the processing machine, such fluid being introduced into said tank adjacent the top thereof.

43. A method as claimed in claim 42 further comprising the step of temporarily interrupting said introducing step, said conducting step and said discharging step, and passing the return fluid from said tank to said second receiver during such interruption.

* * * * *

UNITED STATES PATENT AND TRADEMARK OFFICE

CERTIFICATE OF CORRECTION

PATENT NO. : 4,443,232

DATED : April 17, 1984

INVENTOR(S) : Robert G. Kaiser

It is certified that error appears in the above—identified patent and that said Letters Patent is hereby corrected as shown below:

Col. 24, line 57, in Claim 18 "wherin" should read -- wherein --.

Signed and Sealed this

*Fourth* Day of *September 1984*

[SEAL]

*Attest:*

GERALD J. MOSSINGHOFF

*Attesting Officer*

*Commissioner of Patents and Trademarks*